United States Patent [19]

Obrist et al.

[11] Patent Number: 4,664,279

[45] Date of Patent: May 12, 1987

[54] CLOSURE CAP OF PLASTIC MATERIAL

[75] Inventors: Albert Obrist, Lausanne; Franz T. Bartl, Allschwil, both of Switzerland; Klaus Geisinger, Bad Saeckingen, Fed. Rep. of Germany

[73] Assignee: Crown Obrist AG, Reinach, Switzerland

[21] Appl. No.: 786,965

[22] PCT Filed: Jan. 22, 1985

[86] PCT No.: PCT/CH85/00009

§ 371 Date: Oct. 3, 1985

§ 102(e) Date: Oct. 3, 1985

[87] PCT Pub. No.: WO85/03492

PCT Pub. Date: Aug. 15, 1985

[30] Foreign Application Priority Data

Feb. 6, 1984 [CH] Switzerland ..... 531/84
May 11, 1984 [CH] Switzerland ..... 2327/84

[51] Int. Cl.[4] ..... B65D 41/34
[52] U.S. Cl. ..... 215/252
[58] Field of Search ..... 215/252

[56] References Cited

FOREIGN PATENT DOCUMENTS 2454977 11/1980 France .
2457813 12/1980 France .
2022063 12/1979 United Kingdom .

*Primary Examiner*—Donald F. Norton
*Attorney, Agent, or Firm*—William R. Hinds

[57] ABSTRACT

The tear-off guarantee strip (6) of the closure cap (1) has a peripheral detent edge portion (9) whose inside diameter is smaller than the outside diameter of a peripheral projection (8) on the mouth (3) of a container. In addition to the detent edge portion (9), provided on the inside (7) of the guarantee strip are at least one holding projection (10) and a bead (26), which both strengthen the effect of the detent edge portion (9). The combination of detent edge portion, holding projections and bead gives optimum results in regard to the function of the guarantee strip and the possibility of removing the closure cap from molding tools which open in an axial direction.

16 Claims, 10 Drawing Figures

CLOSURE CAP OF PLASTIC MATERIAL

Figure 1:
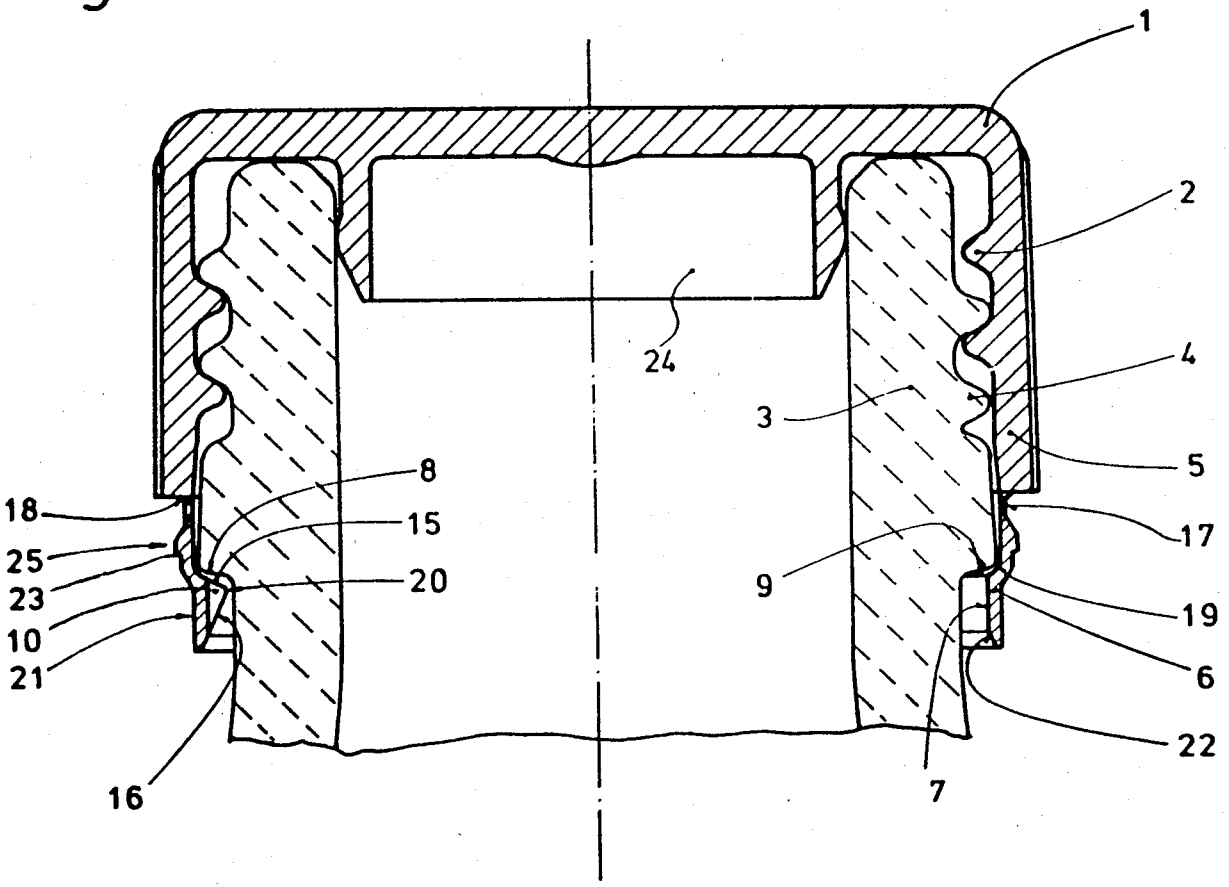

The invention relates to a closure cap of plastic material of the type comprising a female screw thread for closing a mouth of a container having a male screw thread, wherein at its lower edge the cap has a guarantee strip which can be torn off and which is provided on the inside with at least one retaining element which, when the cap is screwed on, engages under an annular projection at the mouth of the container. Closure caps of that kind, with what is referred to as a mechanical guarantee strip, have already been known and conventional for some time. In contrast to shrinkable guarantee strips, mechanical guarantee strips have the advantage that they automatically latch into place when the screw cap is screwed on and that there is no need for additional processing stations such as for example heat shrink tunnels and the like. After the retaining element has latched into place when the closure cap is completely screwed on, the closure cap can only be unscrewed again by destroying the guarantee strip, thus indicating that a container has been opened for the first time.

Difficulties arise in relation to mechanical guarantee strips on the one hand due to the somewhat complicated cross-sectional configuration, when removing the component from the injection moulding tool. On the other hand however it is also necessary to ensure that the mechanical guarantee strip is not damaged at the very time at which the closure cap is being fitted on to the mouth of the container. Therefore, the mechanical guarantee strip must be capable of expanding to a certain degree, when the cap is screwed on, without such expandability having the result, when the closure cap is unscrewed, that the retaining element slides over the annular projection without the guarantee strip being torn away.

GB-A-2 022 063 discloses a closure cap with a mechanical guarantee strip, wherein the retaining element is a bead which extends around the guarantee strip on the inside thereof and which is extended downwardly in a somewhat inclined configuration on one side. The peripheral bead suffers from the disadvantage that it substantially increases the wall thickness of the guarantee strip so that the guarantee strip suffers from over-stretching at the critical location. Such over-stretching can have the result that the bead no longer engages to a sufficient depth beneath the annular projection so that it may be possible for the closure cap to be unscrewed, without the guarantee strip being torn off.

German utility model No. 79 08 673 proposed a very similar principle. In accordance with an alternative embodiment, the bead extends only over a part of the periphery of the guarantee strip. There is no retaining element on the remaining portion. That construction may not be satisfactory insofar as, due to the portion without a retaining element, there is once again the danger that the closure cap can be unscrewed without the guarantee strip being torn off.

A mechanical guarantee strip which is provided on the inside with barb-like means was disclosed in German laid-open application (DE-OS) No. 23 56 007. In that arrangement, the diameter of the guarantee strip is larger than the diameter of the actual closure cap and the guarantee strip is supported with reinforcing ribs against the outside wall of the closure cap. The barb-like means which are proposed in that arrangement can be removed from the injection moulding mould only because the guarantee strip and the side wall of the closure cap are not aligned with each other. In the case of a conventional closure cap for drink bottles, the barb means could not be removed from the mould.

An object of the invention is therefore that of eliminating the above-indicated disadvantages and in particular providing a closure cap of the kind set forth in the opening part of this specification, in which the guarantee strip can be easily fitted on to the mouth of a container, without the danger of being overstretched or the guarantee strip being torn off, while when the closure cap is unscrewed for the first time the guarantee strip is firmly held beneath the projection on the mouth of the container and is separated from the closure cap. A further object of the invention is to provide a cross-sectional configuration which is an optimum configuration from the point of view of injection moulding and which can be removed from the mould, with injection moulding tools which are quick in operation and which provide for an axial mould opening movement. Finally, a further object of the invention is to provide a mechanical guarantee strip which at least partially tears away from the lower edge of the cap at just a low level of unscrewing torque.

According to the invention, that object is achieved by a closure cap having the improvement wherein the retaining element comprises at least two different retaining elements, one being a detent edge portion which engages under the annular projection in one plane and whose inside diameter is smaller than the outside diameter of the projection, and another being at least one circumferentially limited holding projection which projects inwardly toward the center of the cap and which is disposed substantially in the plane of the detent edge portion.

The combination of two different retaining elements takes optimum account of the various requirements, which are in part contradictory, that are made on the guarantee strip. The peripheral detent edge portion has virtually no detrimental effect on the stretchability of the guarantee strip. Nonetheless, it engages under the peripheral projection at the mouth of the container over its entire periphery and thus already serves as a support abutment when the closure cap is being unscrewed. The individual holding projections in the region of the detent edge portion also do not detrimentally affect the stretchability of the guarantee strip. However, they are capable of carrying greater forces in the axial direction so that the guarantee strip is torn off in any case when the closure cap is unscrewed. In addition, the guarantee strip tear-off process may be controlled by means of the number and arrangement of the holding projections.

Finally, the bead serves as a third retaining element, the dimensioning of the bead permitting the stretchability of the guarantee strip to be influenced. The bead forms a full or partial increase in the wall thickness of the guarantee strip.

The three retaining elements co-operate in a particularly advantageous manner if the radial thickness of the bead, on both sides of the holding projections, decreases with increasing distance from the latter in the peripheral direction. By virtue of that arrangement, the bead supports the holding projection without an excessive stiffening effect being produced, in regard to the bead, over the entire periphery. As a result, the guarantee strip remains elastic and does not suffer from being over-stretched when the screw cap is fitted.

It is particularly advantageous for at least two holding projections to be arranged on the guarantee strip, with the bead blending into the detent edge portion between the holding projections. By virtue of that arrangement, at the location where the bead blends into the detent edge portion, the guarantee strip is subdivided into elastic regions while the guarantee strip is increasingly stiffened towards the holding projections.

Desirably, the bead is of a substantially triangular cross-sectional configuration, with the upper boundary surface of the bead, which is towards the end portion of the cap, blending smoothly into the detent edge portion. With that configuration which is also advantageous from the point of view of the injection moulding process, the bead can be easily pushed over the bead on the bottle.

The guarantee strip tears off in a particularly advantageous manner if the guarantee strip has a vertical desired-rupture location, and if a vertical connecting web is disposed in the region of the vertical desired-rupture location, by way of which connecting web the guarantee strip remains joined to the closure cap after the strip has been torn off, wherein at least one holding projection may be disposed in a sector which is substantially opposite to the vertical desired-rupture location. With that arrangement, when the closure cap is unscrewed, the guarantee strip first tears in the sector which is opposite to the vertical desired-rupture location. In that way the unscrewing torque remains at a relatively low level as the guarantee strip does not have to be torn away simultaneously over its entire periphery. The vertical desired-rupture location also finally tears, on the guarantee strip, so that the guarantee strip is then only still joined to the cap by way of the vertical connecting web. That ensures that the guarantee strip does not remain on the mouth of a container, which is particularly important in relation to reusable bottles.

The operation of tearing open the desired-rupture location is advantageously affected if the connecting web is disposed in front of the vertical desired-rupture location, in the direction of unscrewing movement. The strengthened connecting web undergoes practically no flexing so that the desired-rupture location does not bend or stretch when the cap is unscrewed, but tears immediately when the necessary amount of force is reached.

If, besides the connecting web, a further web of smaller cross-section than the connecting web is disposed in front of the connecting web in the direction of unscrewing, that arrangement ensures that the guarantee strip is reliably connected to the closure cap. The second web prevents the connecting web from breaking away in the event of an unscrewing torque being abruptly applied. However, both the connecting web and also the second web can be torn away by hand, by pulling on the guarantee strip, after the guarantee strip has been pulled off the cap or after the vertical desired-rupture location has been broken.

The operation of breaking the vertical desired-rupture location can be further influenced if it has a plurality of desired-tear webs which extend substantially parallel and at a right angle to the centre line. As the vertical desired-rupture location is often torn open by the closure cap being slightly tilted away, the parallel desired-tear webs facilitate that operation. Overstretching of the desired-tear webs can be prevented if they are of a cross-sectional configuration that tapers towards one side. In that way, all webs tear on the same side. The tapering cross-sectional configuration also has advantages in regard to injection moulding as the flow characteristics of the thermoplastic moulding material are advantageously affected, in the injection operation.

If the top side of the holding projections, which is towards the end portion of the cap, is inclined at an angle of between 75° and 85° relative to the centre line, the holding projections may be very easily removed from a mould which opens axially, without their function as a support abutment being adversely affected. If the underside of the holding projections, which is away from the end portion of the cap, is inclined at an angle of between 15° and 30° relative to the centre line, that provides for a careful stretching action in respect of the guarantee strip while it is being pushed over the projection.

Figure 2:
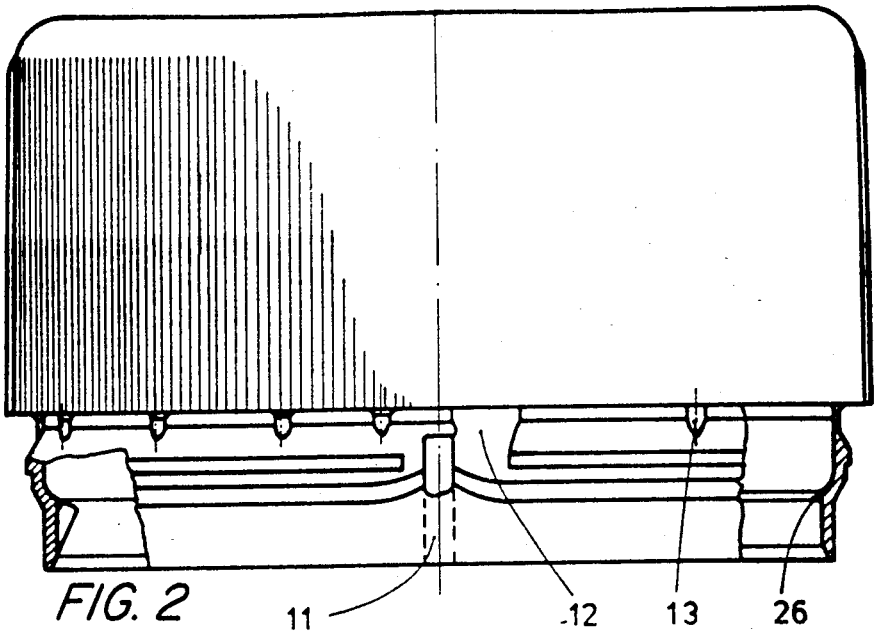
Figure 3:
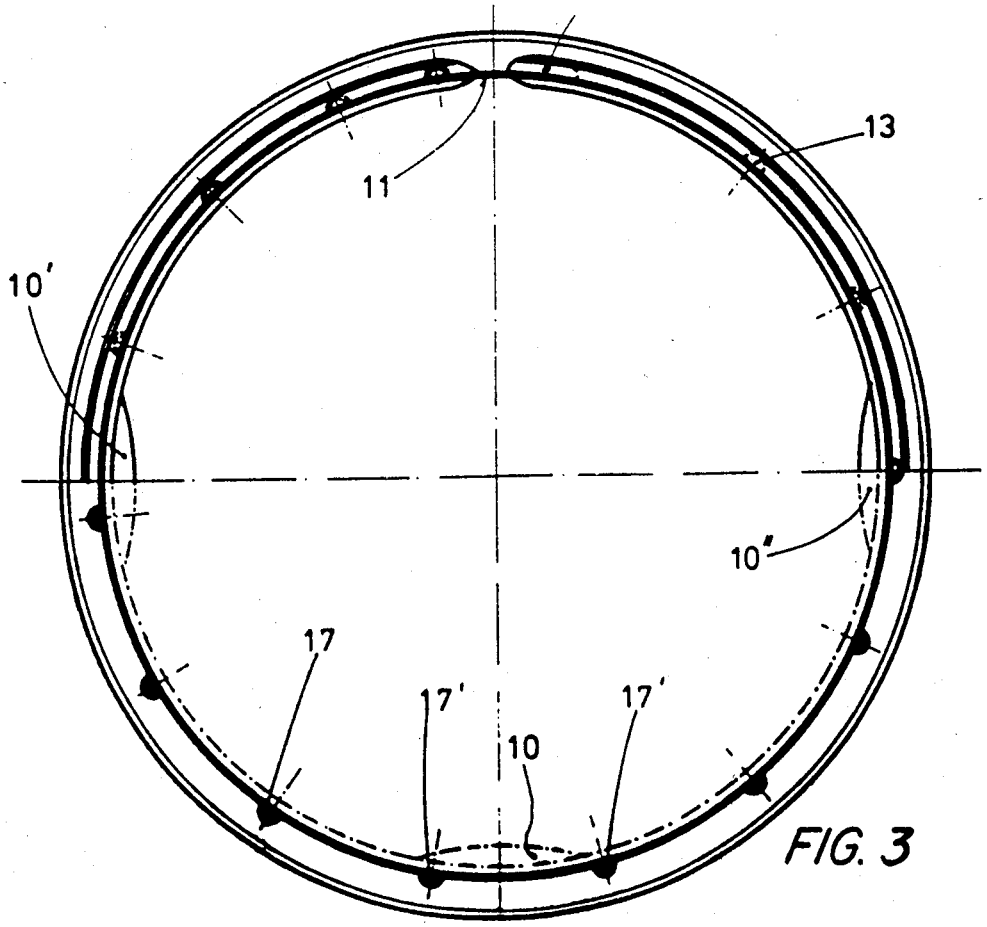
Figure 4:
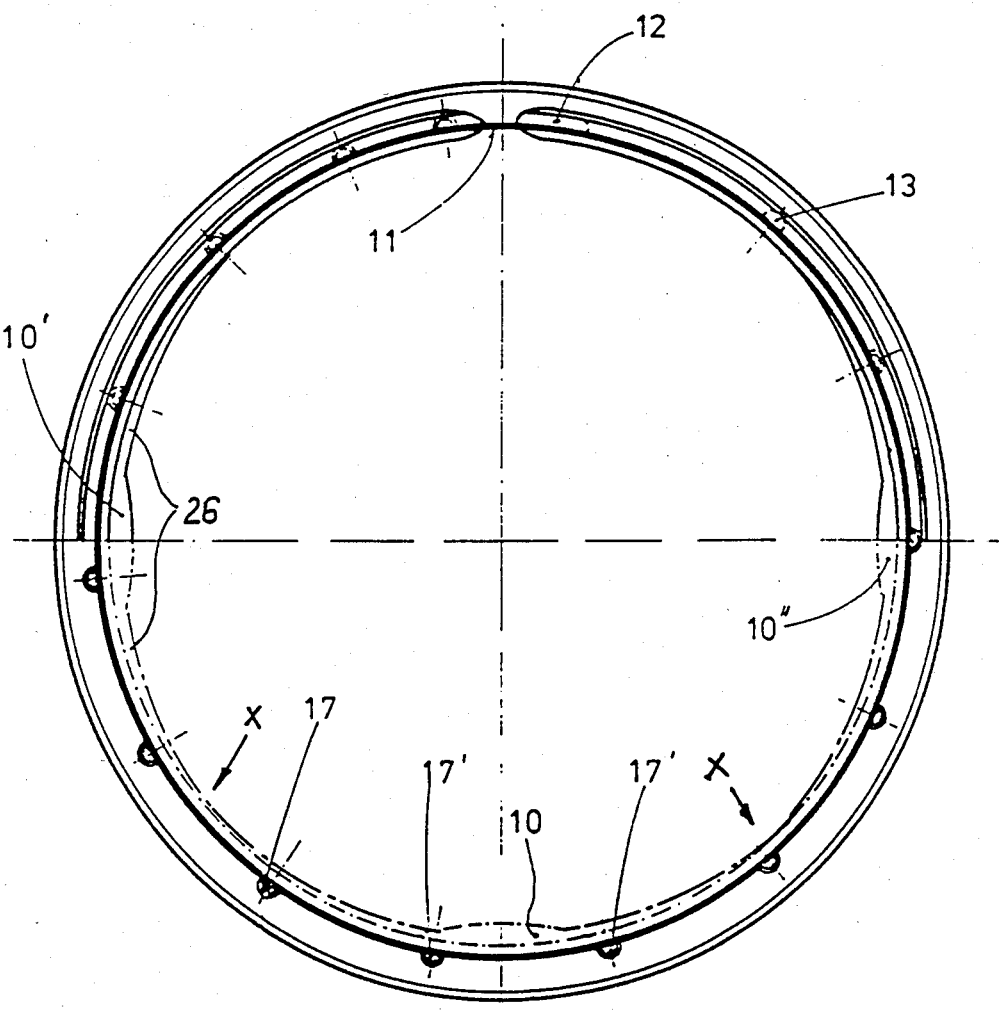
Figure 5:
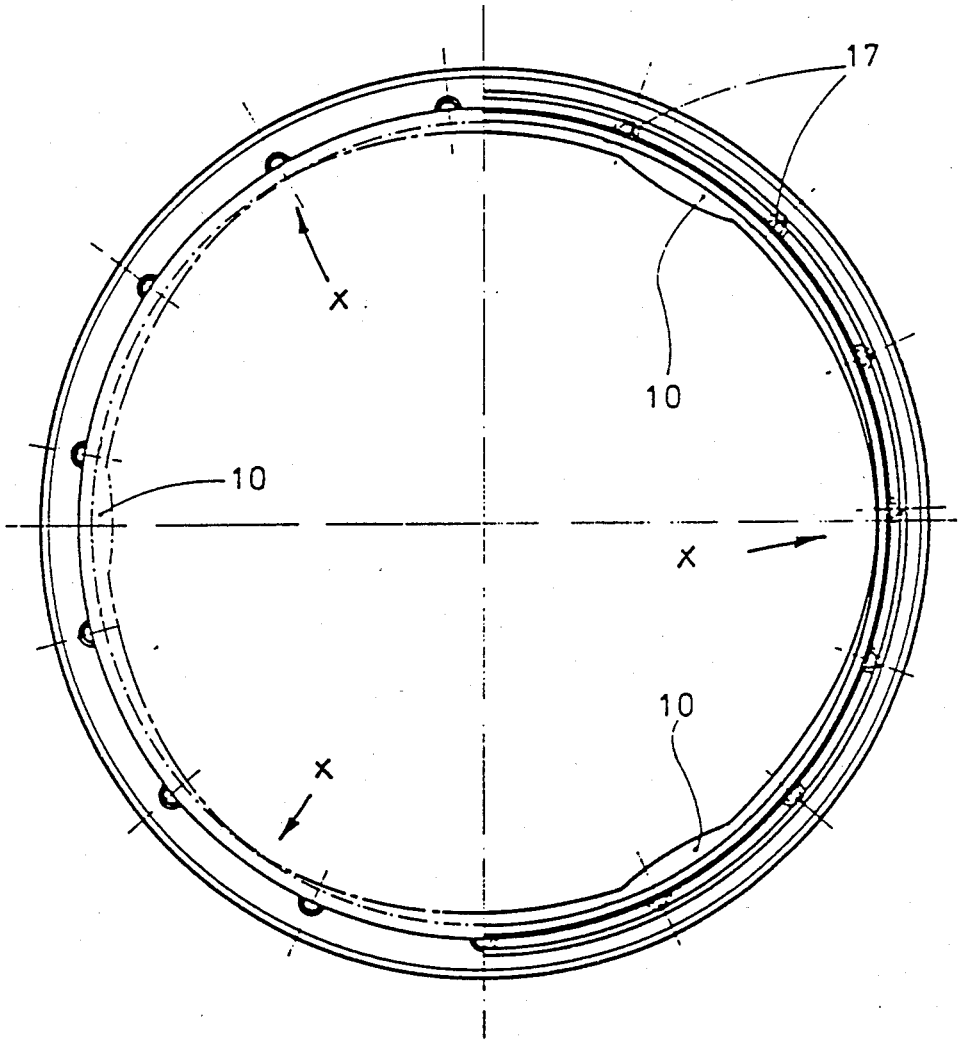
Figure 6:
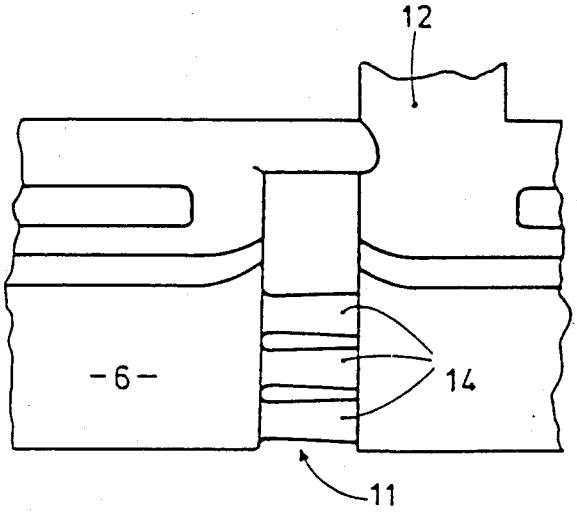
Figure 7:
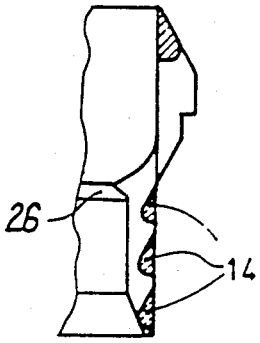
Figure 8:
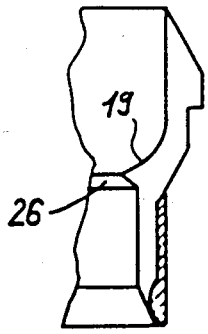
Figure 9:
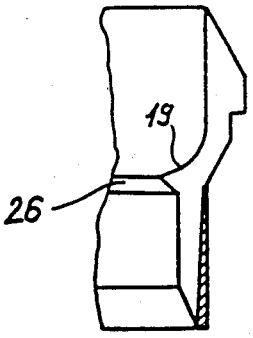
Figure 10:
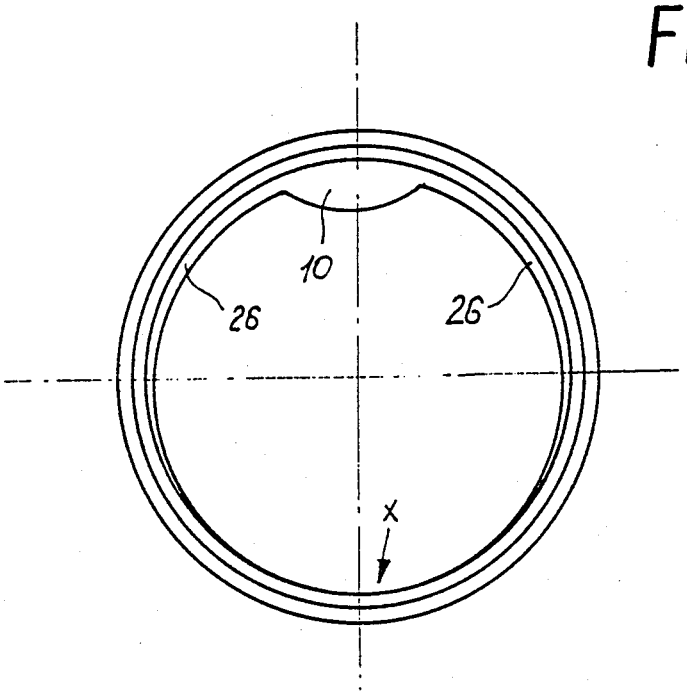

Various embodiments of the invention are described in greater detail hereinafter and illustrated in the drawings in which:

FIG. 1 is a view in cross-section through a closure cap according to the invention, and the mouth of a container, FIG. 2 is a side view of a modified embodiment of a closure cap, FIG. 3 is a view from below of the closure cap shown in FIG. 2, FIG. 4 is a view from below of the closure cap shown in FIG. 2, but with a tapering bead on both sides of the projections, FIG. 5 is a view from below of a modified embodiment for one-trip bottles, FIG. 6 is a view on a greatly enlarged scale of a vertical desired-rupture location, FIG. 7 is a view in cross-section through the desired-rupture location shown in FIG. 6, FIGS. 8 and 9 show modified cross-sectional forms of desired-rupture locations, and FIG. 10 is a view from below of a greatly simplified modified embodiment.

As shown in FIG. 1, a closure cap 1 has a female screwthread 2 so that it can be screwed on to the male screwthread 4 of the mouth 3 of a container. The container mouths are generally standardised bottle mouth configurations, such as for example in Europe the MCA standard for bottles for refreshment drinks (Bachem Carl-Jakob, new association bottles with male screwthread in 'Das Erfrischungsgetränk/Mineral-wasserzeitung', Stuttgart, No 4 of 28th January 1970). The embodiments described hereinafter relate to closure caps for the mouths of bottles in accordance with the MCA standard.

As shown, the closure cap 1 may have an internal seal 24 or however a different sealing system. The guarantee strip 6 is secured to the lower edge 5 by tear-off webs 17. Depending on the situation of use, about 14 to 15 tear-off webs may be disposed over the entire periphery. However, the number of tear-off webs may also be varied, in which respect the total cross-sectional area of all such webs is to be taken into account, in regard to the function of the arrangement. The tear-off webs may be provided at the lower edge with bevel surfaces 18 which are advantageous from the point of view of the injection moulding process. The bevels 18 also strengthen the tear-off webs for the operation of axially removing the moulded components from the moulding tools and for screwing the closure cap on to a container, for the first time.

The guarantee strip itself is divided in terms of its cross-section into an upper portion 25 and a lower portion 21. The upper portion 25 is of approximately the same inside diameter as the closure cap at its lower edge 5. The edge of the guarantee strip which is towards the lower edge 5 of the closure cap is of a substantially wedge-like or tapered configuration, thereby to facilitate the operation of removing the moulded component from the mould. A peripheral shoulder 23 on the outside of the guarantee strip ensures in per se known manner that the guarantee strip is supported when the moulding tools are axially opened. Disposed between the upper portion 25 and the lower portion 21 of the guarantee strip 6 is the detent edge portion 9 which is formed by a reduction in diameter of the guarantee strip. The inside diameter of the inside wall-surface 7 is smaller than the outside diameter of the peripheral projection 8 on the mouth 3 of the container. Therefore, when the closure cap is screwed on for the first time, the detent edge portion or the entire lower guarantee strip portion 21 must be stretched over the bead 8. For that reason, the inside diameter of the inside wall surface 7 is only slightly smaller than the outside diameter of the projection, in order to form a detent edge portion. The inside wall surface of the upper portion 25 of the guarantee strip blends or merges into the detent edge portion 9 with an engagement radius 19 which is about 0.5 to 1.0 mm. Larger radii have an adverse effect on the function of the detent edge portion while smaller radii can give rise to problems on removing the moulded component from the mould. As shown in FIG. 2, the detent edge portion may additionally be strengthened with a peripheral bead 26 which is directed towards the centre.

In the present embodiment, the lower portion 21 of the guarantee strip is of a substantially hollow cylindrical configuration. In that arrangement, the outside diameter of the lower portion 21 approximately corresponds to the inside diameter of the upper portion 25. The wall thickness of the lower portion 21 essentially determines the spring or stretch characteristics when the closure cap is screwed on. The wall thickness selected in the illustrated embodiment is about 0.4 to 0.5 mm. In its lower part, the inside wall surface 7 of the guarantee strip has a conically flaring enlargement portion 22. When the screw cap is screwed on, the portion 22 serves to centre the guarantee strip on the mouth of the container. The angle of the conical enlargement portion 22 is between 15° and 30° relative to the centre line.

Holding projections 10 are arranged on the inside wall surface 7 of the guarantee strip, approximately in the region of the plane of the detent edge portion 9. The holding projections 10, together with the detent edge portion 9, cause the tensile stress on the tear-off webs 17 to rise so sharply, when the closure cap is being unscrewed, that the webs 17 tear. At least one holding projection is required in order to attain the advantages according to the invention. If the projections were to be omitted, the detent edge portion 9 or the bead 26 would have to be of such a size that either the moulded component could no longer be removed from the mould or the guarantee strip would be over-stretched when the cap was screwed on. However, it is also possible for a plurality of holding projections to be disposed in a regular or irregular arrangement over the periphery of the guarantee strip. It is also possible to envisage the holding projections being arranged in slightly offset positions in the axial direction.

The top side 15 of the holding projections 10 and the bead 26 advantageously merges directly into the detent edge portion 9. The angle between the top side 15 and the centre line is advantageously between 75° and 85°. An angle of about 90° would be the optimum angle, per se, but in that case it would be difficult to remove the guarantee strip from the mould. The underside 16 of the holding projections 10 advantageously blends directly into the conically flaring portion and is also of the same angle as that portion.

FIGS. 2, 3 and 4 show a slightly modified embodiment with a vertical desired-rupture location 11 in the guarantee strip. The cross-sectional configuration of the guarantee strip is substantially the same as in the embodiment shown in FIG. 1, although in this case the detent edge portion 9 is further strengthened by a peripheral bead 26. It is possible to make the guarantee strip harder or easier to tear off, depending on the respective dimensioning of the bead 26. FIG. 4 shows a further modified embodiment in which the radial thickness of the bead 26 decreases with increasing distance from the holding projections 10.

Disposed directly adjacent the vertical desired-rupture location 11 is a connecting web 12 at which the guarantee strip still remains joined to the closure cap, after the guarantee strip has been torn off. A further web 13 of smaller cross-section is disposed beside the connecting web 12 and serves to strengthen the connection between the guarantee strip and the closure cap. The vertical desired-rupture location 11 and the connecting web 12 are used in particular in relation to reusable bottles. In the case of reusable bottles, the guarantee strip may not remain on the mouth of the bottle as otherwise, when the bottle is returned, besides the washing operation, it would also be necessary to carry out an additional operating process to remove the guarantee strips.

FIG. 3 shows the arrangement and configuration of the holding projections 10. The holding projections 10 have a segment-like plan configuration and at least one thereof is disposed in a sector which is in approximately opposite relationship to the vertical desired-rupture location. The location 11 is disposed on a peripheral portion whose length, between the two holding projections 10' and 10'', is greater than the length of the portions between those holding projections and the third holding projection 10. That arrangement of the holding projections provides that the individual tear-off webs are torn away in a particularly advantageous fashion. The tear-off webs 17' which are in approximately opposite relationship to the desired-rupture location 11 and the connecting web 12 respectively are the first to tear.

As shown in FIG. 4, the bead 26, between the holding projections 10, 10' and 10'', blends into the detent edge portion 9 or the inside wall surface 7 of the guarantee strip, so that regions X of increased elasticity in the peripheral direction are provided at those locations.

However, the holding projections 10 may also be distributed around the periphery of the guarantee strip in a different fashion. Thus it is possible for example to envisage a plurality of holding projections, for example five thereof, being arranged behind the vertical desired-rupture location in the direction of unscrewing, on a portion of about 180°.

Particularly in relation to one-trip bottles, the holding projections 10 may be uniformly distributed over the periphery of the cap, as shown in FIG. 5. The construction for one-trip bottles also does not have the vertical desired-rupture location 11 and the webs 12 and 13. When the closure cap is unscrewed, the guarantee strip remains on the mouth of the container where it does not cause any further problem.

The decreasing thickness of the bead 26 is particularly clearly visible here. The bead is reduced in substantially uniform manner and blends into the detent edge portion approximately centrally between two holding projections 10. It is also possible however for the radial thickness of the bead 26 to be of a different configuration from that illustrated. For example, the bead 26 could first be approximately of a uniform radial thickness, and only then begins to taper down at a distance from the holding projections 10. The zones X where there is increased elasticity or where the bead is greatly reduced or omitted could also be of greater or smaller length.

FIGS. 6 and 7 show views on a greatly enlarged scale of a vertical desired-rupture location 11, wherein the desired-rupture location has desired-tear webs 14 which extend in substantially parallel relationship. The webs 14 are of a cross-section which tapers substantially conically towards one side. That arrangement ensures that all webs 14 tear at the smallest cross-section, on one side. That therefore prevents over-stretching. As shown in FIGS. 8 and 9, however, it is also possible to envisage other configurations for the vertical desired-rupture location. Thus for example it would be possible to provide a thin film with an increase in thickness at the lower edge as shown in FIG. 8 or a thin substantially wedge-shaped film as shown in FIG. 9.

FIGS. 7 and 9 also clearly show the bead 26 whose top side blends smoothly into the detent edge portion or into the radius 19.

FIG. 10 is a greatly simplified view of a modified embodiment with only a single holding projection 10 and with a bead 26 whose radial thickness uniformly decreases down to the location X which is approximately opposite to the holding projection 10. It will be seen that numerous modifications can also be envisaged in this construction.

The properties of the material used should also be taken into consideration in arriving at the dimensions of the individual portions of the guarantee strip. The closure caps are normally produced from polyethylene or polypropylene. The closure caps according to the invention may be fitted on to the mouths of containers using conventional cap fitting equipment, which is a further advantage.

We claim:

1. A closure cap of plastic material comprising a female screwthread (2) for closing a mouth (3) of a container having a male screwthread (4), wherein at its lower edge (5) the cap has a substantially circumferentially continuous guarantee strip (6) which can be torn off and which is provided on the inside (7) with at least one retaining element which, when the cap is screwed on, engages under an annular projection (8) at the mouth of the container, the improvement wherein said at least one retaining element comprises:

a detent edge portion (9) which extends generally continuously around substantially the entire inner circumferential surface of the guarantee strip and which engages under the annular projection (8) in one plane over substantially its entire periphery and whose inside diameter is smaller than the inside diameter of the lower edge of the cap so as to be smaller also than the outside diameter of the projection, and at least one circumferentially intermittent holding projection (10) which projects inwardly towards the center of the cap and which is disposed substantially in the plane of the detent edge portion (9).

2. A closure cap according to claim 1 characterised in that the detent edge portion (9) is strengthened by a bead (26) which projects inwardly from the inner surface of the guarantee strip.

3. A closure cap according to claim 2 characterised in that the radial thickness of the bead (26), on both sides of each holding projection, (10), decreases with increasing distance from the holding projection in the peripheral direction.

4. A closure cap according to claim 3 characterised in that there are at least two holding projections (10) and that the bead merges into the detent edge portion (9) between the holding projections.

5. A closure cap according to claim 2 characterised in that the bead is substantially triangular in cross-section, the upper boundary surface of the bead, which is towards the lower edge of the cap, merging smoothly into the detent edge portion.

6. A closure cap according to claim 1 characterised in that the guarantee strip (6) has a vertical tear line (11) and that disposed in the region of the vertical tear line is a vertical connecting web (12) by way of which the guarantee strip remains joined to the closure cap after having been otherwise torn off.

7. A closure cap according to claim 6 characterised in that at least one said holding projection (10) is disposed in a sector which is approximately opposite to the vertical tear line.

8. A closure cap according to claim 6 characterised in that there are at least three said holding projections (10), the projections being distributed around the periphery of the guarantee strip in such a way that the vertical tear line (11) is respectively disposed in a portion between two holding projections, the length of which is greater than the spacing between same and the other holding projections or between the other holding projections relative to each other.

9. A closure cap according to claim 6 characterised in that the connecting web portion (12) is disposed in front of the vertical tear line (11) in the direction of unscrewing.

10. A closure cap according to claim 9 characterised in that, beside the connecting web (12), a further web (13) of smaller cross-section than the connecting web (12) is arranged in front of the connecting web in the direction of unscrewing.

11. A closure cap according to claim 6 characterised in that the vertical tear line (11) has a plurality of tear webs (14) which extend parallel to each other and at a right angle to the cap centre line.

12. A closure cap according to claim 11 characterised in that the tear webs (14) are of a cross-sectional configuration that tapers towards one side.

13. A closure cap according to claim 1 characterised in that the top side (15) of each holding projection (10) is inclined at an angle of between 75° and 85° relative to the cap centre line.

14. A closure cap according to claim 13 characterised in that the underside (16) of each holding projection (10) is inclined at an angle of between 15° and 30° relative to the cap centre line.

15. A closure cap of plastic material comprising a female screwthread (2) for closing a mouth (3) of a container having a male screwthread (4), wherein at its lower edge (5) the cap has a substantially circumferentially continuous guarantee strip (6) which can be torn off and which is provided on the inside (7) with at least one retaining element which, when the cap is screwed on, engages under an annular projection (8) at the mouth of the container, the improvement wherein said at least one retaining element comprises:

a detent edge portion (9) which extends generally continuously around substantially the entire inner circumferential surface of the guarantee strip and which engages under the annular projection (8) in one plane over substantially its entire periphery and whose inside diameter is smaller than the inside diameter of the lower edge of the cap so as to be smaller also than the outside diameter of the projection, and at least one circumferentially intermittent holding projection (10) which projects inwardly towards the centre of the cap and which is disposed substantially in the plane of the detent edge portion (9), and a bead which projects inwardly from the inner surface of the guarantee strip at the detent edge portion and strengthens the detent edge portion.

16. In combination, a container having a male screwthread, and a closure cap of plastic material for closing a mouth of the container, the closure cap having at its lower edge a substantially circumferentially continuous guarantee strip which can be torn off and which is provided on the inside with at least one retaining element which, with the cap screwed on, engages under an annular projection at the mouth of the container, the improvement wherein the at least one retaining element comprises: a detent edge portion which extends generally continuously around substantially the entire inner circumferential surface of the guarantee strip and which engages under the annular projection in one plane over substantially its entire periphery and whose inside diameter is smaller than the outside diameter of the annular projection, and at least one circumferentially intermittent holding projection which projects inwardly toward the center of the cap and which is disposed substantially in the plane of the detent edge portion, said holding projection projecting inwardly from the area of said detent edge portion over a relatively small part of the circumference of the detent edge portion.

* * * * *